United States Patent [19]

Keaton

[11] Patent Number: 4,614,217

[45] Date of Patent: Sep. 30, 1986

[54] METHOD OF ASSEMBLING A HORIZONTAL SHELL MOLD CASTING SYSTEM AND THE RESULTING SYSTEM

[75] Inventor: Robert E. Keaton, Westminster, Calif.

[73] Assignee: The Garrett Corporation, Los Angeles, Calif.

[21] Appl. No.: 651,221

[22] Filed: Sep. 14, 1984

[51] Int. Cl.[4] ..... B22C 9/02; B22C 9/08; B22C 9/20; B22D 35/04

[52] U.S. Cl. ..... 164/137; 164/130; 164/350; 164/361; 164/362; 164/364

[58] Field of Search ..... 164/137, 129, 130, 350, 164/361, 362, 364; 249/110, 119

[56] References Cited

U.S. PATENT DOCUMENTS

| | | | |
|---|---|---|---|
| 390,371 | 10/1888 | Huffelmann | 249/110 X |
| 672,402 | 4/1901 | Cowden . | |
| 1,319,779 | 10/1919 | Levey . | |
| 1,454,647 | 5/1923 | McFarland | 249/119 X |
| 1,533,067 | 4/1925 | McNelly . | |
| 1,579,743 | 4/1926 | Warlow, Jr. | 164/129 |
| 1,645,725 | 10/1927 | Vaughan . | |
| 1,698,836 | 1/1929 | Bartley et al. . | |
| 1,729,005 | 9/1929 | Morehead . | |
| 1,757,549 | 5/1930 | Smith et al. | 164/129 |
| 1,817,340 | 8/1931 | Barr . | |
| 2,416,451 | 2/1947 | Magnus . | |
| 2,475,805 | 7/1949 | Saylor . | |
| 2,837,797 | 6/1958 | Norton et al. | 164/350 |
| 3,283,376 | 11/1966 | Hockin | 164/129 |
| 3,598,175 | 8/1971 | Olson et al. | 164/129 X |
| 3,697,037 | 10/1972 | Recasens . | |
| 3,779,506 | 12/1973 | Adams . | |
| 3,837,614 | 9/1974 | Palovits et al. . | |
| 4,072,180 | 2/1978 | Hoult | 164/130 |
| 4,126,292 | 11/1978 | Saeki et al. . | |
| 4,239,724 | 12/1980 | Adell . | |
| 4,340,107 | 7/1982 | Bauer | 164/350 X |
| 4,356,994 | 11/1982 | Thornton | 249/110 X |
| 4,359,202 | 11/1982 | Gerding et al. | 249/110 X |

FOREIGN PATENT DOCUMENTS

| | | | |
|---|---|---|---|
| 298421 | 5/1971 | U.S.S.R. | 164/137 |

*Primary Examiner*—Nicholas P. Godici
*Assistant Examiner*—J. Reed Batten, Jr.
*Attorney, Agent, or Firm*—J. Henry Muetterties; Albert J. Miller; James W. McFarland

[57] ABSTRACT

A horizontal casting technique and mold for use specifically with shell molds and runner feeder sections. The runner feeder sections are assembled within the shell molds such that the ends of the runner feeder section protrude from the mold and can be flow connected to a runner feeder of an adjacent assembly. A plurality of these assemblies constitute the horizontal mold having a horizontal runner feeder and a plurality of shell molds in spaced, side-by-side relationship.

21 Claims, 3 Drawing Figures

METHOD OF ASSEMBLING A HORIZONTAL SHELL MOLD CASTING SYSTEM AND THE RESULTING SYSTEM

BACKGROUND AND SUMMARY OF THE INVENTION

The present invention relates to a mold for and method of simultaneously pouring and more particularly to what is known as horizontal casting, i.e. casting of a multitude of castings in adjacent molds from a common, horizontal runner feeder.

In the past, the normal means of pouring a plurality of molds simultaneously has been through vertical or stack casting techniques. In this technique, the molds are placed one on top of the other and are positioned so that the runner feeder which connects the cavities of each mold is vertical. Molten metal, which is poured into the vertical mold's down sprue, falls to the bottom of the runner feeder to a point adjacent the cavity of the bottom mold. The molten metal experiences turbulence when it strikes the bottom of runner feeder after being poured. The bottommost mold is filled initially with the turbulent molten metal which in turn creates a casting of unacceptable quality. As the molds are filled from the bottom up, so is the runner feeder, hence new molten metal is continuously free falling from the down sprue to the top of the molten metal in the runner feeder. Turbulent molten metal is therefore flowing into each successively higher mold cavity, resulting in casts of poor quality.

Furthermore, when the molds are stacked vertically the static pressure of the molten metal causes what is commonly known as "burn out". Burn out occurs when the molten metal penetrates the mold material and causes ruptures or seepage at the mold joints. A burnout on a vertical mold can result in complete failure of all the castings which make up the vertical mold.

In order to eliminate the effects of turbulent molten metal on the quality of the cast article, the technique of horizontal casting has been developed. The technique is so named because the molds are placed in an abutting side-by-side relationship with a common, horizontally aligned runner feeder between the molds. Each mold has at least one cavity and ingate associated therewith. Molten metal flowing through the horizontal runner feeder flows into the mold cavities through their associated ingates. This method eliminates the high magnitude of turbulence associated with vertical runner feeders, but creates turbulence when the molten metal flows from the runner feeder into the mold cavity.

In addition, horizontal casting techniques and molds of the past have been subject to burn out problems and poor casting quality because of their design. Specifically, the molds have been of the investment and air-set type which are expensive and labor intensive because of the difficulty of fashioning a runner feeder integral with the mold and because the molds have been placed in abutting, side-by-side relationship. Furthermore, the ingates and the runner feeder have been sized so that molten metal is filling two adjacent molds simultaneously. Hence when burn out occurs there are at least two molds destroyed and the normal practice of destroying the rest of the molds.

According to the present invention, a horizontal mold arrangement for use in the casting of molten metal comprises a plurality of shell molds secured together in spaced, side-by-side relationship. Each mold has at least one mold impression or mold cavity formed therein below the runner feeder center line and ingate means connecting the mold cavity (ies) to a portion of the runner feeder. The runner feeder forms a weir associated with each mold and together with the mold forms a riser which lies above the mold cavity. The minimum cross-sectional area of the runner feeder is being less than the total cross-sectional area(s) of all ingates associated with a single mold. This last feature ensures that during the casting operation any turbulence created within the mold cavity is not trapped within the mold cavity as with the molds of the prior art. Hence, molten metal poured into the down sprue is channeled within the runner feeder to the first riser whereupon the molten metal begins to fill the mold cavity. Any turbulence eventually rises out of the cavity through the ingate and out into the riser area and is swept downstream by the molten metal in the runner feeder until it is eventually removed from the mold system. Therefore, the present invention solves several of the problems associated with the horizontal casting techniques of the past. Specifically, a burn out will only result in the destruction of one mold since all of the rest can be saved. In addition, molten metal turbulence has been minimized and therefore casting quality improved.

Accordingly, it is an object of the present invention to provide a horizontal casting technique which reduces the destructive effects of a burn out.

It is another object of the present invention to provide a horizontal casting technique which utilizes shell molds.

It is another object of the present invention to provide a horizontal mold system which reduces the turbulence of the molten metal to a minimum.

It is a further object of the present invention to reduce the total amount of liquid metal required to effectively feed appropriately designed riser feeders, thus saving remelting energy.

It is a further object of the present invention to provide an easily manufactured runner feeder for use with the horizontal casting technique.

DETAILED DESCRIPTION OF THE INVENTION

Figure 1:
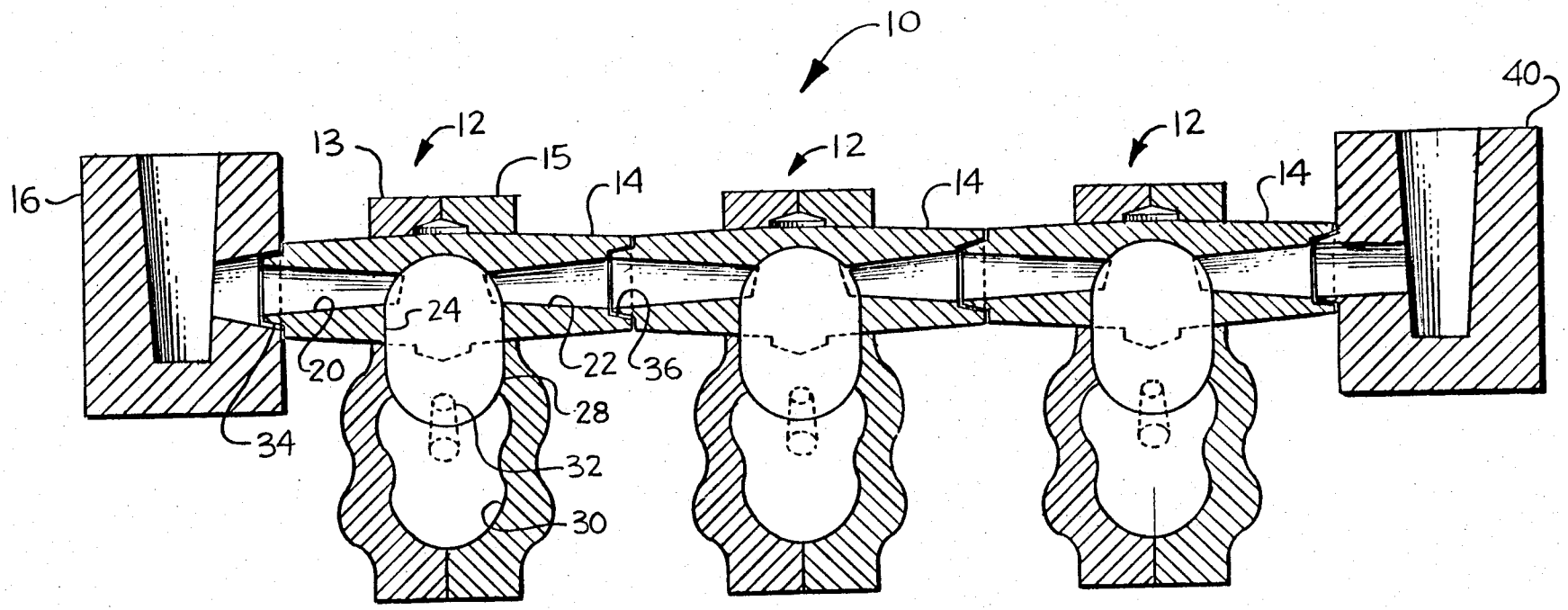
FIG. 1 is a cross-sectional view of the horizontal mold system of the present invention.

Referring to the drawings, shown is a horizontal mold system 10 according to the present invention. The mold system 10 includes a plurality of shell molds 12 which are aligned besides one another in spaced, side-by-side relationship. Connecting adjacent molds 12 are runner feeder sections 14 which are adapted to accept identical runner-feeder sections at either end thereof. There is a down sprue 16 attached to one end of the horizontal mold system 10 through which the molten metal enters the runner feeder.

Figure 2:
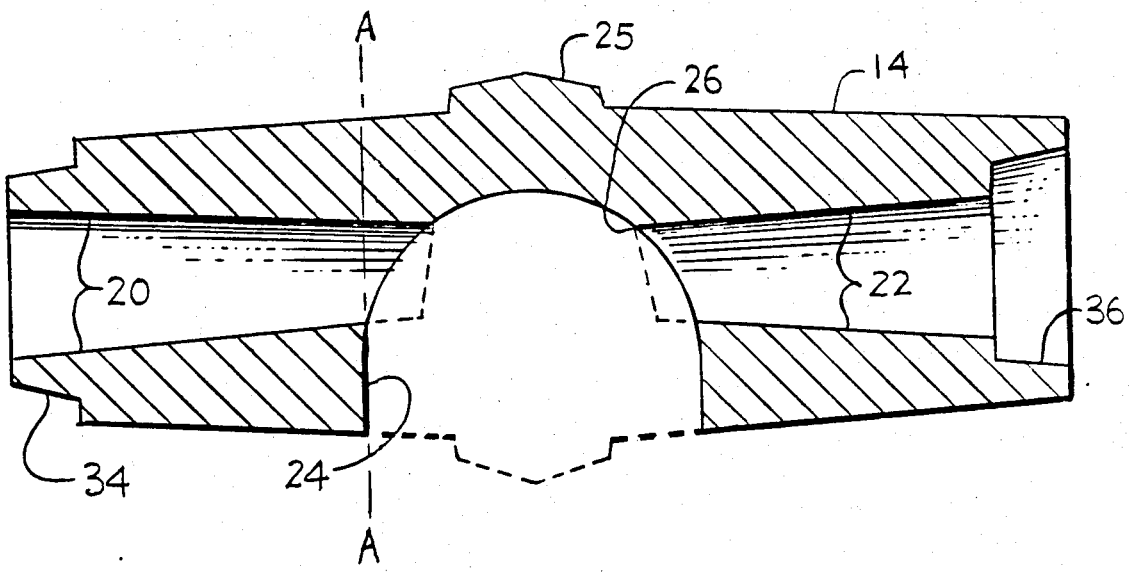
FIG. 2 is a cross-sectional view of an individual runner feeder section, according to the present invention.
Figure 3:
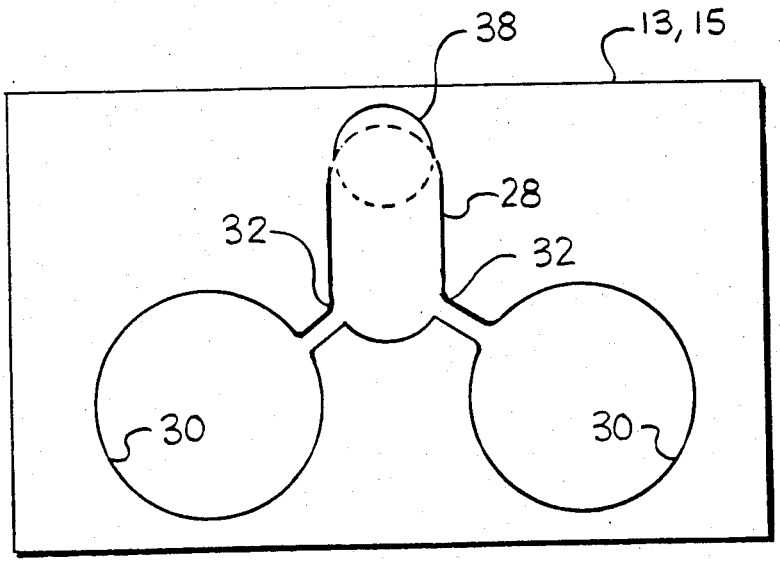
FIG. 3 is a side cross-sectional view of an individual shell mold having two mold cavities therein.

Shown in FIG. 2 is the runner feeder section 14. As shown, the runner feeder section 14 has coaxial converging and diverging passages, 20 and 22 respectively. These passages are separated by a generally semispherically shaped cavity 24 which forms a weir 26 and the top portion of a riser 28. The runner feeder section is formed with male and female ends, 34 and 36 respectively, in order that they may mate with adjacent runner feeder sections. In addition, the runner feeder section has a generally annular flange 25 located at the midpoint between the two section ends. This flange is useful for locating the shell mold onto the runner feeder section during assembly thereto.

Shell mold 12 is made in two pieces, 13 and 15, each half is complementary to the other and between them they form the bottom portion of the riser 28, an ingate means 32 and at least one mold cavity 30. The bottom portion of the riser formed within the shell mold complements the top portion which is formed in the runner feeder 14. The ingate means 32 connects the riser 28 to the mold cavity. In addition, each half of the shell mold is formed with a opening 38 which is sized to accommodate the runner feeder 14. In its assembled state, the top portion of the riser formed within the runner feeder 14 and the bottom portion of the riser formed within the shell mold combine to form the riser 28.

During the casting operation, molten metal is poured into the down sprue 16 and flows horizontally through the converging passage 20 of the runner feeder 14 adjacent the down sprue 16. The molten metal then falls into the bottom of the riser 28 where some of the turbulent flow created by the fall into the riser 28 is dissipated. The riser 28 then fills until the level of molten metal therein reaches the level of the ingate means 32. The mold cavity 30 then begins to fill as the molten metal is continuously poured into the down sprue 16. It is important that the total cross-sectional area of all the ingate means 32 associated with any one mold be greater than the cross-sectional area of the runner feeder at its narrowest point, see Section A—A in FIG. 2. This limitation ensures that the riser 28 associated with the mold adjacent the down sprue will never fill before the mold cavities associated with that well are filled. Hence no molten metal will flow over a weir into the convergent passage of the runner feeder until the cavities of the mold are filled. This ensures that all turbulence will be carried out of the mold cavities. Furthermore, this limitation ensures that the pour rate is controlled by the minimum cross-sectional area of the runner feeder. Once the cavities of the mold adjacent the down sprue are filled, the riser associated therewith is filled and molten metal now spills over the weir formed by the first runner feeder section and mold. The molten metal enters the diverging portion of the runner feeder passage and experiences a decrease in speed and the amount of turbulence before it enters the converging section of the downstream runner feeder secion which increases the speed of the molten metal and the turbulence thereof. However, since the convergence and divergence of the runner feeder is minimal, the net effect on the speed and turbulence of the molten metal when traveling between a weir and the downstream riser is negligible.

As shown in FIG. 1 there is attached to the downstream end of the mold system 10 a relief sprue 40 which begins to fill after the molds have been filled and alerts the operator to that fact. In another embodiment, the down sprue can be fashioned so that it can be located between two such mold systems as shown in FIG. 1. Furthermore, a cap can be used in place of the relief sprue since experience will teach the operator the amount of molten metal to be poured in order to fill all of the molds.

The horizontal mold system 10 is assemblied by first forming a plurality of shell or investment molds as is well known in the art. The shell molds have several features which are unique to this invention, i.e. the circular opening to accommodate the runner feeder and the relative positions and sizes of the ingate and well as described above. The runner feeder sections are themselves made separately from the shell mold. These sections are made by conventional shell core techniques using inserts to form the runner feeder passage. In order to ensure that the runner feeder can be removed from the mold the outer surfaces and the internal passage (runner feeder passage) are drafted. This explains the converging and diverging sections of the passage.

Each half of a shell mold is slid over an end of the runner feeder section and are glued together or secured together by well known means thereby securing the runner feeder to mold. The desired number of these assemblies are placed in side-by-side relationship with the female end 36 of one section accepting the male end 34 of the adjacent assembly. Once the desired member of molds have been aligned, a down sprue is attached to one end and a relief sprue or cap to the other.

Although the invention has been shown and described to a preferred embodiment thereof, it should be understood by those skilled in the art that various changes and omissions in the form and detail thereof may be made therein without departing from the spirit and scope of this invention.

Having thus described an embodiment of my invention, that which I now claim as new and desired to secure by Letters Patent of the United States is:

1. A method of assembling a horizontal mold system having a horizontal runner feeder comprising the steps of:

sliding complementary halves of a shell mold over the ends of a runner feeder section;

securing the two halves together to form a mold such that the ends of the runner feeder section protrude therefrom;

constructing at least one additional mold by the above steps and mating the ends of the runner feeder sections of at least two molds together to form the horizontal mold system.

2. The method of claim 1 further including the step of connecting a down sprue to one of the protruding runner feeder ends.

3. The method of claim 1 further including the step of connecting a down sprue to said horizontal runner feeder section between said plurality of molds.

4. The method of claim 1 further including the step of forming a mold cavity and a riser between said complementary halves.

5. The method of claim 4 further including the step of forming an ingate between said riser and mold cavity.

6. A horizontal casting mold system comprising:

a plurality of shell molds in spaced, side-by-side relationship, each mold being formed from complementary halves and defining a mold cavity therein;

a runner feeder associated with each of said molds, said runner feeder having a passage means for carrying molten metal therethrough, said runner feeder held between the halves of said shell mold such that the ends of the runner feeder extend therefrom; and means formed within said mold and said runner feeder means for passing molten metal from said runner feeder to said mold cavity.

7. The horizontal casting mold system of claim 6 wherein said runner feeder comprises a generally cylindrically shaped body having coaxial converging and diverging passages therein, said converging passage and diverging passage being separated by a cavity.

8. The horizontal casting mold system of claim 7 wherein said runner feeder body includes male and female ends, each matable with the complementary ends of like runner feeders.

9. The horizontal casting mold system of claim 7 wherein said cavity is generally semispherically shaped.

10. The horizontal casting mold system of claim 7 wherein said runner feeder includes an annular flange at approximately its mid point.

11. The horizontal casting mold system of claim 10 wherein said complementary halves of said shell molds include cut-out sections to accommodate said flange.

12. The horizontal casting mold system of claim 6 wherein said means for passing molten metal comprises a riser and an ingate, said ingate flow connecting said riser to the mold cavity.

13. The horizontal casting mold system of claim 12 wherein said ingate is located above the bottom of said riser.

14. The horizontal casting mold system of claim 13 wherein each shell mold defines at least two mold cavities and an ingate associated with each cavity.

15. The horizontal casting mold system of claim 14 wherein the minimum cross-sectional area of said passage in said runner feeder is less than the sum of the cross-sectional areas of all ingates in any one mold.

16. A mold for use in a horizontal casting mold system, said mold comprising:

a generally cylindrically shaped runner feeder having a passage therethrough and a generally annular flange therearound;

complementary halves of a shell mold which define a mold cavity therebetween, said halves having aligned openings slidable over the runner feeder, said openings having a cross-sectional area smaller than the flange diameter;

means for securing said halves together such that said flange is located between the two halves of the mold; and means formed within said mold and runner feeder for passing molten metal from said runner feeder to said mold cavity.

17. The mold of claim 16 wherein said mold defines at least two mold cavities and an ingate associated with each cavity.

18. The mold of claim 17 wherein the minimum cross-sectional area of said runner feeder passage is less than the sum of the cross-sectional areas of all ingates in the mold.

19. The mold of claim 16 wherein said runner feeder passage comprises coaxial converging and diverging passages separated by a cavity.

20. The mold of claim 19 wherein said means for passing molten metal comprises a riser and an ingate, said ingate flow connecting said riser to the mold cavity.

21. The mold of claim 20 wherein the cross-sectional area of the ingate is greater than the minimum cross-sectional area of the runner feeder passage.

* * * * *